US006528938B1

(12) United States Patent
Jansma

(10) Patent No.: US 6,528,938 B1
(45) Date of Patent: Mar. 4, 2003

(54) FLUORESCENT LAMP HAVING A SINGLE COMPOSITE PHOSPHOR LAYER

(75) Inventor: Jon B. Jansma, Pepper Pike, OH (US)

(73) Assignee: General Electric Company, Schenectady, NY (US)

( * ) Notice: Subject to any disclaimer, the term of this patent is extended or adjusted under 35 U.S.C. 154(b) by 313 days.

(21) Appl. No.: 09/694,234

(22) Filed: Oct. 23, 2000

(51) Int. Cl.[7] ..... H01J 63/04

(52) U.S. Cl. ..... 313/485; 313/486; 313/487; 313/493; 313/634; 313/635; 313/636

(58) Field of Search ..... 313/485, 486, 313/487, 493, 634, 635, 636, 479

(56) References Cited

U.S. PATENT DOCUMENTS

| | | | | |
|---|---|---|---|---|
| 3,937,998 | A | 2/1976 | Verstegen et al. | 313/487 |
| 4,088,802 | A | 5/1978 | Shriver, Jr. | 427/67 |
| 4,088,923 | A | 5/1978 | Manders | 313/487 |
| 4,335,330 | A | 6/1982 | Peters et al. | 313/486 |
| 4,431,941 | A | 2/1984 | Roy et al. | 313/487 |
| 4,806,824 | A | 2/1989 | Paynter et al. | 313/486 |
| 4,847,533 | A | 7/1989 | Hoffman | 313/487 |
| 5,045,752 | A | 9/1991 | Jansma | 313/487 |
| 5,602,444 | A | 2/1997 | Jansma | 313/489 |
| 5,714,836 | A | 2/1998 | Hunt et al. | 313/487 |
| 5,726,528 | A | 3/1998 | Jansma et al. | 313/489 |
| 5,838,100 | A | 11/1998 | Jansma | 313/485 |

FOREIGN PATENT DOCUMENTS

| | | |
|---|---|---|
| EP | 0 257 554 B1 | 3/1993 |
| EP | 0 856 871 A1 | 8/1998 |
| JP | 55-122338 | 9/1980 |

*Primary Examiner*—Robert H. Kim
*Assistant Examiner*—Jurie Yun
(74) *Attorney, Agent, or Firm*—Pearne & Gordon LLP

(57) ABSTRACT

A mercury vapor discharge fluorescent lamp is provided having a single composite phosphor-containing layer. The composite layer contains both a heterogeneous mixture of halophosphors, rare earth triphosphors and colloidal alumina particles. The coating weight and relative proportion of halophosphors to triphosphors are both tunable to obtain a lamp having specific performance characteristics suitable to a particular application. The colloidal alumina particles contained in the composite layer eliminate the need for a separately applied alumina layer as is conventional in the prior art.

17 Claims, 3 Drawing Sheets

FLUORESCENT LAMP HAVING A SINGLE COMPOSITE PHOSPHOR LAYER

BACKGROUND OF THE INVENTION

1. Field of the Invention

The present invention relates generally to a fluorescent lamp and more particularly to a fluorescent lamp having an improved composite phosphor layer.

2. Description of Related Art

There are two principal types of phosphors used in fluorescent lamps: relatively inexpensive halophosphors, and relatively expensive rare earth phosphors. Halophosphors, though commonly used due to their low cost, exhibit poor color rendering properties and lower lumens compared with more expensive rare earth phosphors. Rare earth phosphors, for example blended into a triphosphor layer as is known in the art, exhibit excellent color rendering properties and high lumens but are used sparingly due to their high cost.

The fluorescent lighting industry has adopted a dual-coating technology for producing certain medium performance lamps incorporating both halophosphors and rare earth triphosphors. "Medium performance" as used herein means performance (in terms of color rendering properties and lumens) intermediate between that of inexpensive halophosphors and expensive rare earth triphosphors. The dual-coating technology involves applying halophosphors and rare earth triphosphors as discrete coating layers with the more expensive triphosphor layer placed in the well-utilized second coat next to the arc discharge. Medium performance fluorescent lamps produced using this dual-coating technique have become quite popular and account for between 70%–90% of fluorescent lamp sales worldwide.

Despite the popularity of this dual-coating technology, the application of phosphors as discrete layers presents many significant manufacturing problems. Initially, the expensive triphosphor layer is very thin, often less than a monolayer of particles, contributing to significant variations in thickness and uniformity of the triphosphor layer during the application process. Such variations result in increased variations in the color rendering index (CRI) and lamp brightness which are strongly related to the triphosphor layer thickness.

Other manufacturing difficulties include a narrow range of acceptable coating additives (such as dispersants and surfactants), as well as elevated coating and production costs. Each coating step increases production losses and requires significant equipment and labor usage.

In addition to two discrete phosphor layers, fluorescent lamps of the prior art require a third discrete boundary layer of alumina particles coated directly onto the glass tube beneath the phosphor layers. This third layer of alumina prevents UV emission from the fluorescent lamp by reflecting unconverted UV radiation back toward the interior of the lamp where it is subsequently converted to visible light by the phosphors. The alumina layer also minimizes mercury loss due to reaction with the glass tube. The addition of this third coating layer further increases production losses due to equipment and labor usage.

There is a need in the art for a lamp that combines halophosphors, rare earth phosphors or triphosphors and alumina particles into a single blended composite coating that can be applied as a single layer in a single step in the production of medium performance fluorescent lamps.

SUMMARY OF THE INVENTION

A mercury vapor discharge lamp is provided comprising a light-transmissive envelope having an inner surface, means for providing a discharge, a discharge sustaining fill of mercury and an inert gas sealed inside the envelope, and a single composite layer coated on the inner surface of the envelope. The composite layer is provided is having at least one type of halophosphor, at least three types of rare earth phosphors, and colloidal alumina particles in a heterogeneous mixture.

DETAILED DESCRIPTION OF THE PREFERRED EMBODIMENTS

In the description that follows, when a preferred range, such as 5 to 25 (or 5–25), is given, this means preferably at least 5, and separately and independently, preferably not more than 25. When a range is given in terms of a weight percent (weight %) for a single component of a composite mixture, this means that the single component is present by weight in the composite mixture in the stated proportion relative to the sum total weight of all components of the composite mixture.

Figure 1:
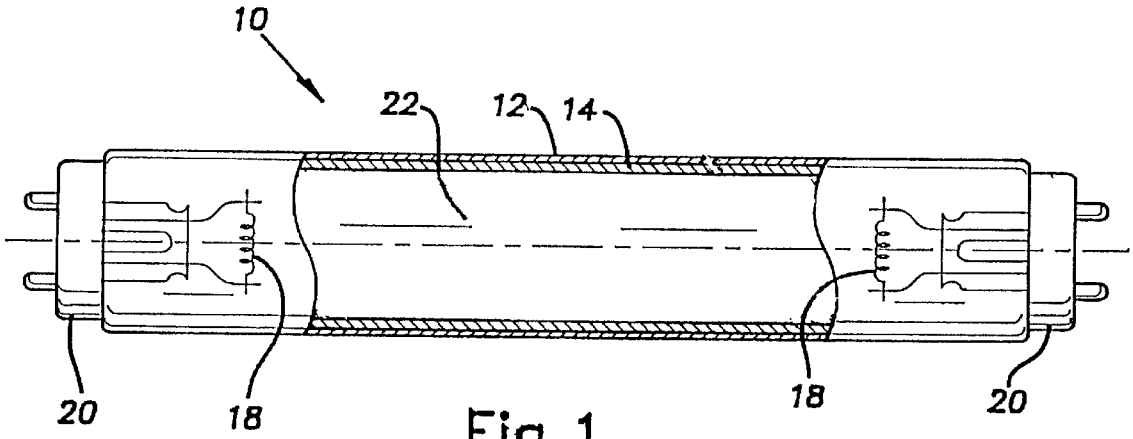
FIG. 1 shows diagramatically, and partially in section, a fluorescent lamp having a single composite phosphor layer according to the present invention.

FIG. 1 shows a representative low pressure mercury vapor discharge fluorescent lamp 10, which is generally well known in the art. The fluorescent lamp 10 has a light-transmissive glass tube or envelope 12 which has a circular cross-section. The inner surface of the glass envelope is provided with a single composite phosphor-containing layer 14 according to the present invention.

The lamp is hermetically sealed by bases 20 attached at both ends, and a pair of spaced electrode structures 18 (which are means for providing a discharge) are respectively mounted on the bases 20. A discharge-sustaining fill 22 of mercury and an inert gas is sealed inside the glass tube. The inert gas is typically argon or a mixture of argon and other noble gases at low pressure which, in combination with a small quantity of mercury, provide the low vapor pressure manner of operation.

The invented composite phosphor-containing layer 14 is preferably utilized in a low pressure mercury vapor discharge lamp, but may also be used in a high pressure mercury vapor discharge lamp. It may be used in fluorescent lamps having electrodes as are known in the art, as well as in electrodeless fluorescent lamps as are known in the art, where the means for providing a discharge is a structure which provides high frequency electromagnetic energy or radiation.

Figure 2:
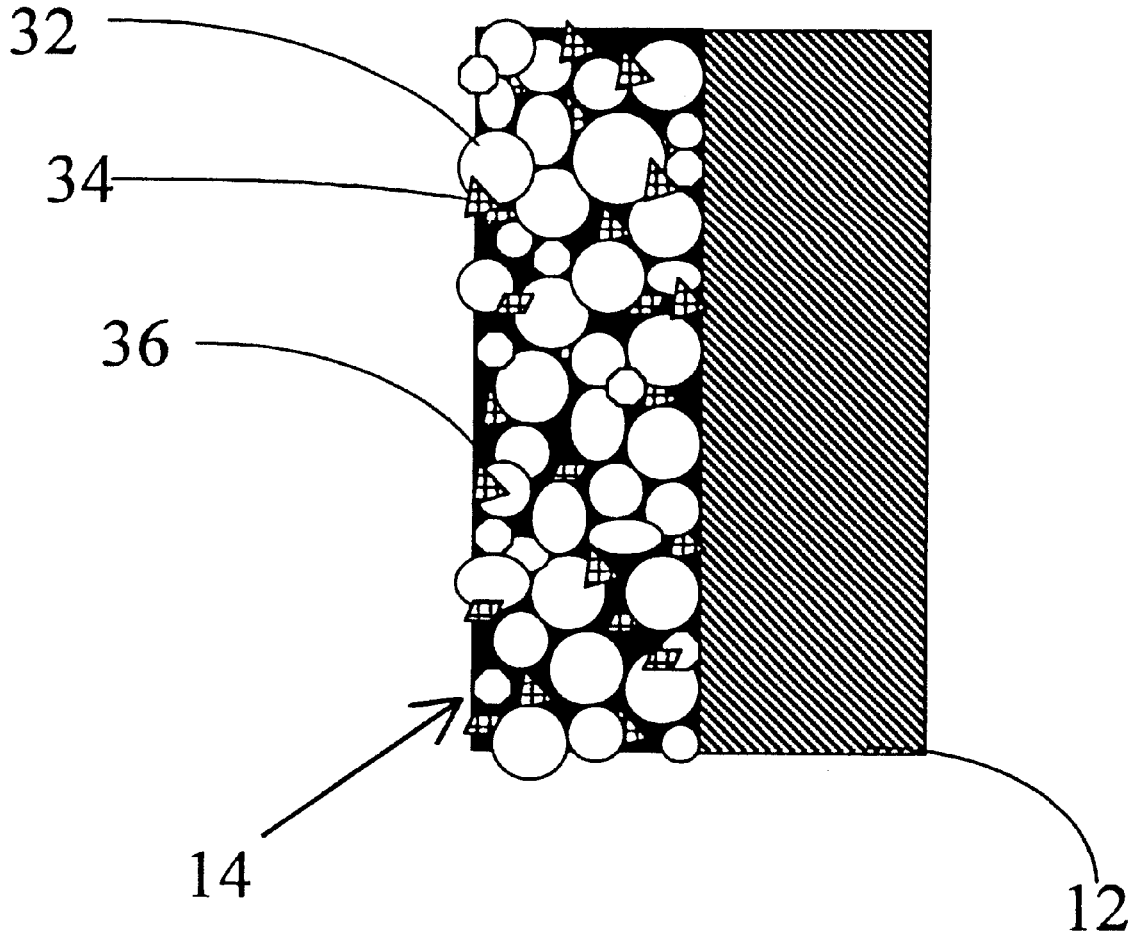
FIG. 2 shows a cross-section of a composite phosphor-containing layer of the present invention coated on the inner surface of a glass envelope of a fluorescent lamp.

With further reference to FIG. 2, the invented phosphor-containing layer 14 comprises halophosphors 32, rare earth phosphors 34, and colloidal alumina particles 36, all blended together in a heterogeneous mixture of substantially uniform composition as shown in FIG. 2. Preferably, the rare earth phosphors 34 comprise a blended triphosphor system as is known in the art, such as a blend comprising red, blue, and green color-emitting rare earth phosphors as disclosed in U.S. Pat. Nos. 5,045,752, 4,088,923, 4,335,330, 4,847,533, 4,806,824, 3,937,998, and 4,431,941. Less preferably, rare earth phosphor blends comprising other numbers of rare earth phosphors, such as systems with 4 or 5 rare earth phosphors, may be used.

The halophosphor particles 32 in the phosphor-containing layer 14 may comprise, for example, mixture of calcium halophosphate activated with antimony and manganese. Preferably, manganese is 0.5–5, more preferably 1–4, more preferably 1.5–3.5, more preferably 2–3, more preferably 2.2, mole percent of the halophosphor mixture. Preferably, antimony is 0.2–5, more preferably 0.5–4, more preferably 0.8–3, more preferably 1–2.5, more preferably 1–2, more preferably 1.6, mole percent of the halophosphor mixture. Alternatively, other halophosphor particles known in the art may be used. The halophosphor particles are provided having a narrow particle size distribution and substantially uniform shape, without complex structural features that would tend to reflect ultraviolet (UV) radiation away from the phosphor particles. Narrow particle size distribution and minimization of complex structural features preferably are achieved via air- or wet-size classification techniques as are commonly known in the art, though any suitable size classification technique may be used. The halophosphor particles 32 are provided preferably about 10, less preferably between 9–11, less preferably between 8–12, less preferably between 7–13 micrometers in diameter, with a minimum of fines (particles having a diameter of about 5 micrometers or less), preferably not more than 5, more preferably 4, more preferably 3, more preferably 2, more preferably 1, more preferably 0.5, percent fines.

The rare earth phosphor particles 34 (preferably a mixture of triphosphors as is known in the art) are likewise provided having a narrow particle size distribution and uniform shape via size classification techniques, having a minimum of complex structural features that would tend to reflect UV radiation away from the phosphor particles. Preferably, the rare earth phosphor particles are provided having a size distribution between 3–5, less preferably 3–6, less preferably 2–6, less preferably 1–6 micrometers in diameter.

The phosphor-containing layer 14 is 0.05–40, more preferably 0.1–30, more preferably 0.2–20, more preferably 0.3–20, more preferably 0.4–15, more preferably 0.5–10, more preferably 1–10, more preferably 2–8, weight percent alumina. The alumina particles in the phosphor-containing layer 14 are of a range of particle sizes, preferably 10–1000, more preferably 12–800, more preferably 14–600, more preferably 16–400, more preferably 18–300, more preferably 20–200, more preferably 30–150, more preferably 50–100, nanometers in diameter, and are uniformly size distributed throughout the phosphor-containing layer 14. The alumina particles beneficially reflect UV radiation toward phosphor particles where it may be utilized, leading to improved phosphor utilization and more efficient production of visible light. In this manner, the alumina particles 36 minimize UV emission from the fluorescent lamp 10 and maximize the utilization of the rare earth triphosphors 34, achieving maximum lamp efficiency with a lower proportion of expensive rare earth phosphors 34.

The three principal components of the phosphor-containing layer 14 (halophosphor particles, rare earth phosphor particles, and colloidal alumina particles as described above) preferably are packed to a maximum bulk density in a substantially nested configuration based upon the three modes of particle size characteristic of the three different types of particles. Specifically, the small alumina particles, having colloidal size or dimension, fill in the void spaces (pores, crevices and cavities) between the rare earth phosphor particles which are several orders of magnitude larger in dimension or diameter than the alumina particles. The rare earth triphosphor particles, in turn, are tightly packed against the larger halophosphor particles to achieve maximum filling of the void space between the larger halophosphor particles, thereby achieving maximum density in the phosphor-containing layer 14. The resulting composite mixture is preferably of uniform bulk density, particle composition and size distribution.

The lamp of the present invention is made without a discrete or separate boundary layer of alumina particles as known in the prior art, and is made without a second coating of phosphors or a second phosphor-containing layer. In addition to greatly reducing labor and equipment costs compared with the three-coat design of the prior art, the single-coat composite phosphor-containing layer 14 of the present invention significantly reduces the variability in performance characteristics. An experiment was performed comparing an F40T12 SP35 fluorescent lamp of the prior art having discrete halophosphor and rare earth triphosphor layers, with a similar lamp having a single composite phosphor-containing layer 14 according to the present invention. The color rendering index and lumens after 100 hours were measured for both lamps. The results are tabulated below.

| | CRI | | Lumens, 100 hours | |
|---|---|---|---|---|
| Lamp | Avg. | S. Dev. | Avg. | S. Dev. |
| SP35 Dual-Coat | 71.3 | 2.4 | 2750 | 50 |
| SP35 Single-Coat | 74.0 | 0.2 | 2750 | 25 |

As seen above, the single-coat lamp exhibited comparable average performance relative to the dual-coat lamp. However, the variability in both CRI and lumens were significantly decreased in the single-coat design. The single-coat lamp exhibited only a 0.27% standard deviation in CRI, compared with 3.37% for the dual-coat lamp, approximately corresponding to a 12-fold decrease in CRI variability. Further, the variability in 100-hour lumens was reduced by half for the single-coat lamp. Such a significant reduction in CRI variability, as well as lumen variability, was surprising and unexpected. Reduction in variability of both CRI and lumens is key to providing customer satisfaction and coating cost control.

The relative proportion of halophosphors to rare earth phosphors in the phosphor-containing layer 14 is determined by cost, lumen, color and CRI constraints relative to a particular application. For example, relative compositions in the range of 50–99, 50–95, 50–90, 50–85, 50–80, 50–75, 50–70, 50–65, or 50–60 weight percent halophosphor (with the balance being rare earth phosphors and colloidal alumina) may be used. A relative composition of between 50–70 weight percent halophosphor and between 0.5–10 weight percent colloidal alumina has been found to be sufficient in achieving medium performance in General Electric's F40T12 SP35 and SP41 fluorescent lamps. The phosphor-containing layer 14 is preferably 5–50, more preferably 10–50, more preferably 20–40, more preferably 30–40, more preferably 30–35, weight percent rare earth phosphors.

The composite phosphor-containing layer 14 is provided having a coating weight preferably between 2–10, more preferably 3–8, more preferably 4–6, more preferably 3.40–7.00 mg/cm$^2$. Coating weights outside the above range may be used to enhance lamp performance for a particular application. A principal advantage of the present invention is that a lamp comprising a single composite phosphor-containing layer 14 can be tuned to achieve the desired CRI for a particular application. In the dual-coat design of the prior art, CRI is a strong function of coating weight making it extremely difficult to tune a lamp to a desired CRI without compromising lumens. In the single-coat design, however, coating weight and the proportion of halophosphors to rare earth triphosphors can be tuned to provide a lamp having specific performance characteristics for both CRI and lumens.

The invented lamp preferably has a CRI of at least 62, preferably 65, preferably 68, preferably 70, preferably 72, preferably 73. The invented lamp preferably has a lumen output of at least 77.5, preferably 78, preferably 78.5, preferably 79, preferably 79.5, preferably 80, lumens/watt. For example, for a 40-watt lamp according to the present invention, lumen output is preferably at least 3100, preferably 3120, preferably 3140, preferably 3160, preferably 3180, preferably 3200, lumens. The invented phosphor-containing layer 14 is preferably used in medium performance SP-type lamps, for example SP30, SP35, SP41, SP50, or SP65 fluorescent lamps. Optionally, the invented phosphor-containing layer may be utilized in other medium performance lamps known in the art, as well as in high performance lamps, for example General Electric's SPX-type lamps.

Figure 3:
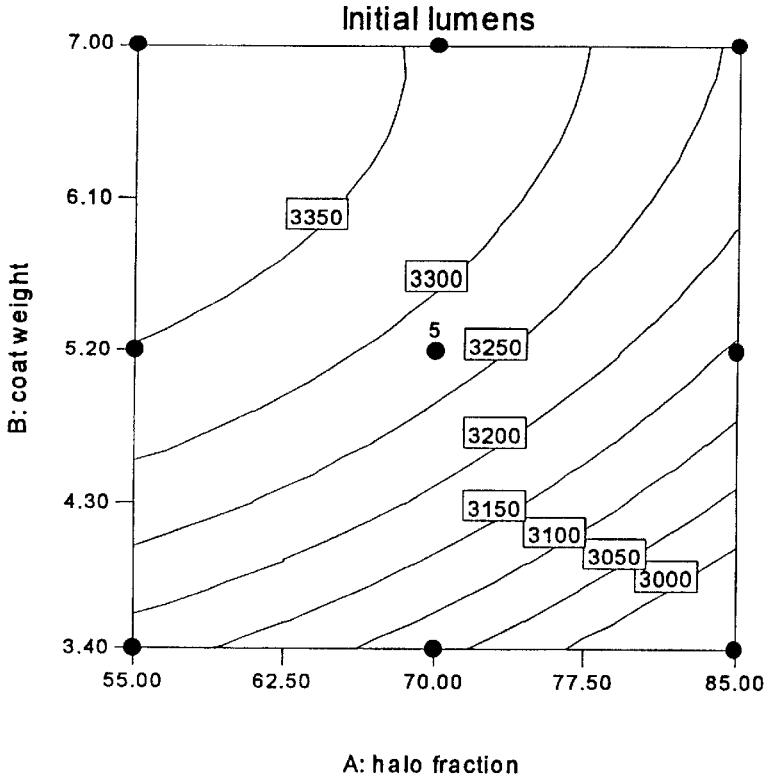
FIG. 3 graphically shows experimental results of initial lumen performance as a function of both coating weight and halofraction (weight % halophosphor relative to rare earth triphosphor) for fluorescent lamps according to the present invention.
Figure 4:
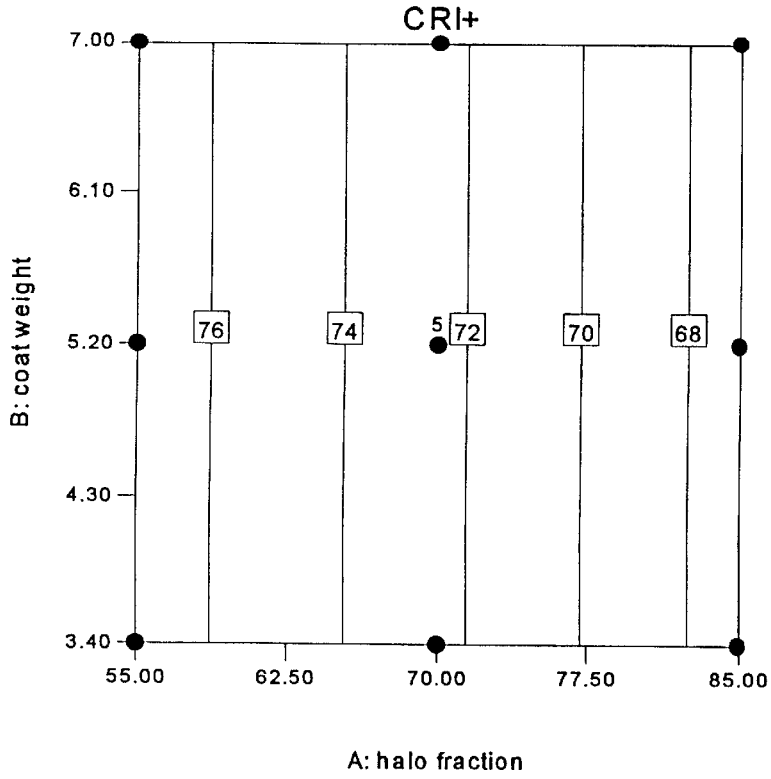
FIG. 4 graphically shows experimental results of CRI as a function of both coating weight and halofraction for fluorescent lamps according to the present invention.

Referring to FIGS. 3 and 4, experiments were conducted with 9 specially prepared F40T12 mercury vapor discharge fluorescent lamps having coating weights and halophosphor proportions (halofractions) as shown in the following table. The colloidal alumina content in the composite coating was fixed at 5 weight percent for all lamps. All coating weights are in mg/cm$^2$, and rare earth triphosphors made up the balance of the coatings.

| Lamp | Coating Weight | % Halophosphor |
|---|---|---|
| 1 | 3.40 | 85 |
| 2 | 5.20 | 85 |
| 3 | 7.00 | 85 |
| 4 | 3.40 | 70 |
| 5 | 5.20 | 70 |
| 6 | 7.00 | 70 |
| 7 | 3.40 | 55 |
| 8 | 5.20 | 55 |
| 9 | 7.00 | 55 |

FIG. 3 shows the lumens resulting from each of the 9 F40T12 lamps and, via computer simulation, interpolated lumen performance within the entire range of halofractions tested. As can be seen from the figure, the present invention allows ease of lumen design by varying either halofraction or coating weight.

FIG. 4 was generated in similar manner to FIG. 3, and shows CRI as a function of halofraction and coating weight within the experimental range. As the figure indicates, CRI is virtually independent of coating weight in the single-coat phosphor-containing layer 14 of the present invention. This coating-weight independence is a significant advance over the dual-coated phosphor layers of the prior art, where CRI is strongly dependent upon coating weight. Coating-weight independence allows lumen output to be extremely finely tuned by varying coating weight without sacrificing CRI. Consequently, a lamp utilizing a single phosphor-containing layer according to the present invention has the advantage of precise tunability to a specific application without sacrificing other untuned performance characteristics.

A composite phosphor-containing layer 14 as described above eliminates the need for a separate alumina barrier layer coating on the glass envelope 12 as required by the prior art. In the present invention, the phosphor-containing layer 14 is coated on the interior surface of the glass envelope 12, in direct contact therewith. In addition, by blending halophosphors and rare earth triphosphors into a single heterogeneous mixture of substantially uniform composition, the dual-coating technology of the prior art is replaced with a single phosphor coating that is effective in providing similar medium performance in fluorescent lamps at greatly reduced production and equipment cost. The composite phosphor-containing layer 14 of the present invention effectively combines a three-step process, requiring three discrete coating applications, into a single coating that is applied in a single step.

The composite phosphor-containing layer 14 is prepared as a codispersion of halophosphors and rare earth triphosphors in an aqueous vehicle containing colloidal alumina as described above. The Theological properties of this coating formulation are controlled during the production and application processes in the following manner. The colloidal alumina particles which are provided in a range of particle sizes, e.g. 20–200 nanometers as described above, beneficially induce mild electrostatic stabilization of the halophosphor and rare earth triphosphor particles of different size, thereby inhibiting ordering by size which could lead to color flooding in the finished lamp product. The use of colloidal alumina in this manner is preferable to the use of polyelectrolyte dispersants which can induce particle ordering by size. Additionally, the coating formulation is kept slightly acidic, ideally between pH 5–7, to assure the colloidal alumina exhibits sufficient surface charge to act as an effective mild dispersant in the phosphor dispersion.

Preferably, hydrochloric or nitric acid is used to maintain suitable coating formulation pH, though any suitable acidic reagent can be used. A preferably nonionic thickener, preferably polyethylene oxide having a molecular weight in the range of 200,000 to 1,000,000 gm/mol is used in the formulation as a viscosity controlling additive. Surfactant additives are also preferably nonionic, and are added to control coating leveling and improve wetting of the glass tube 10. Surfactants are preferably selected from the class of nonylphenyl ethoxylates, though any suitable nonionic surfactant can be used. Acrylic-based thickeners and dispersants as are commonly used in the prior art are avoided, thereby eliminating the well known problem of ammonia emissions in the manufacturing environment associated with ammonia-neutralized acrylics.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge lamp comprising a light-transmissive envelope having an inner surface, means for providing a discharge, a discharge-sustaining fill of mercury and inert gas sealed inside said envelope, and a single composite layer coated inside said envelope, said composite layer comprising at least one halophosphor, at least three rare earth phosphors, and colloidal alumina particles in a heterogeneous mixture.

2. A lamp according to claim 1, wherein said heterogeneous mixture is of uniform composition.

3. A lamp according to claim 1, wherein said means for providing a discharge comprise electrodes.

4. A lamp according to claim 1, wherein said means for providing a discharge comprise a structure that provides high frequency electromagnetic energy.

5. A lamp according to claim 1, wherein said composite layer is 0.05 to 40 weight percent colloidal alumina particles.

6. A lamp according to claim 1, wherein said composite layer is 50 to 99 weight percent halophosphors.

7. A lamp according to claim 1, wherein said composite layer is 5 to 50 weight percent rare earth phosphors.

8. A lamp according to claim 1, wherein said colloidal alumina particles present in said composite layer have a range of mean diameters in the range of 10 to 1000 nm.

9. A lamp according to claim 1, wherein said halophosphor particles present in said composite layer have a mean diameter in the range of 7–13 $\mu$m.

10. A lamp according to claim 9, wherein said halophosphor particles comprise not more than 5% fines having a mean diameter of 5 $\mu$m or less.

11. A lamp according to claim 9, wherein said halophosphor particles comprise calcium halophosphate activated with antimony and manganese.

12. A lamp according to claim 1, wherein said composite layer is packed in a nested particle configuration, wherein said colloidal alumina particles substantially fill in the void spaces between said rare earth phosphors, said rare earth phosphors substantially filling in the void spaces between adjacent halophosphors.

13. A lamp according to claim 1, wherein said rare earth phosphors present in said composite layer are of substantially uniform surface configuration having a mean diameter in the range of 1–6 $\mu$m.

14. A lamp according to claim 12, wherein said rare earth phosphors comprise a blended triphosphor system comprising red, blue and green color-emitting phosphors.

15. A lamp according to claim 1, wherein said composite layer is formed as a coating formulation comprising a dispersion of halophosphors, rare earth phosphors, and colloidal alumina particles in an aqueous vehicle further comprising nonionic thickeners and nonionic surfactants.

16. A lamp according to claim 1, said lamp having a CRI of at least 62.

17. A lamp according to claim 1, said lamp having a lumen output of at least 77.5 lumens/watt.

* * * * *